US010958021B2

(12) United States Patent
Lyu

(10) Patent No.: US 10,958,021 B2
(45) Date of Patent: Mar. 23, 2021

(54) ULTRA-HIGH FREQUENCY SUPER THIN COAXIAL RF CONNECTOR ASSEMBLY

(71) Applicant: HARUMOTO TECHNOLOGY (SHEN ZHEN) CO., LTD., Shenzhen (CN)

(72) Inventor: Yi-Gen Lyu, Shenzhen (CN)

(73) Assignee: HARUMOTO TECHNOLOGY (SHEN ZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/522,655

(22) Filed: Jul. 26, 2019

(65) Prior Publication Data

US 2020/0036143 A1 Jan. 30, 2020

(30) Foreign Application Priority Data

Jul. 27, 2018 (CN) ..... 2018 1 0846310

(51) Int. Cl.
*H01R 24/50* (2011.01)
*H01R 24/52* (2011.01)
*H01R 24/54* (2011.01)

(52) U.S. Cl.
CPC ..... *H01R 24/50* (2013.01); *H01R 24/52* (2013.01); *H01R 24/542* (2013.01); *H01R 24/545* (2013.01)

(58) Field of Classification Search
CPC .... H01R 2103/00; H01R 24/50; H01R 24/52; H01R 24/54; H01R 24/545; H01R 24/542
USPC ..... 439/63, 581
See application file for complete search history.

(56) References Cited

U.S. PATENT DOCUMENTS 5,466,160 A * 11/1995 Ogura ..... H01R 24/50 333/260
6,264,475 B1 * 7/2001 Machado ..... H01R 24/52 439/63
6,533,610 B1 * 3/2003 Dai ..... H01R 24/50 439/581
6,758,680 B2 * 7/2004 Duquerroy ..... H01R 24/50 439/63

(Continued)

*Primary Examiner* — Gary F Paumen
(74) *Attorney, Agent, or Firm* — Chun-Ming Shih; Lanway IPR Services

(57) ABSTRACT

An ultra-high frequency super thin coaxial RF connector assembly comprising a combination of an ultra-high frequency super thin coaxial RF board side connector and an ultra-high frequency super thin coaxial RF wire side connector, wherein the arrangement of a traditionally conventional board side connector center terminal is omitted for the ultra-high frequency super thin coaxial RF board side connector, for the ultra-high frequency super thin coaxial RF wire side connector to transfer an RF signal to a circuit board directly without using an RF board side center terminal. As such, there is no need to arrange a board side center terminal in the Ultra high frequency super thin coaxial RF board side connector, so that a board side shield terminal in the Ultra high frequency super thin coaxial RF board side connector may provide an electrical shield more effectively, allowing the ultra-high frequency super thin coaxial RF connector assembly of the present invention to be capable of providing an RF signal in an UHF (Ultra High Frequency) millimeter wave band above 30 GHz for transmission.

9 Claims, 20 Drawing Sheets

(56) References Cited

U.S. PATENT DOCUMENTS

| | | | | |
|---|---|---|---|---|
| 7,445,458 | B1 * | 11/2008 | Yamane | H01R 4/028 439/63 |
| 2013/0171876 | A1 * | 7/2013 | Funahashi | H01R 24/50 439/620.03 |
| 2013/0244486 | A1 * | 9/2013 | Ohsaka | H01R 12/57 439/581 |
| 2014/0030917 | A1 * | 1/2014 | Mason | H01R 9/0515 439/581 |
| 2014/0273550 | A1 * | 9/2014 | Biddle | H01R 12/7005 439/63 |

* cited by examiner

ULTRA-HIGH FREQUENCY SUPER THIN COAXIAL RF CONNECTOR ASSEMBLY

CROSS-REFERENCE TO RELATED APPLICATIONS

This application claims the priority of China Patent Application No. 201810846310.3 filed on Jul. 27, 2018, in the State Intellectual Property Office of the China, the disclosure of which is incorporated herein by reference.

BACKGROUND OF THE INVENTION

Field of the Invention

The present invention relates to an ultra-high frequency super thin coaxial RF connector, and more particularly, the present invention relates to an ultra-high frequency super thin coaxial RF connector assembly for transmitting an UHF (Ultra High Frequency) millimeter wave band RF signal in the case of omission of arrangement for an RF board side center terminal.

Descriptions of the Related Art

In recent years, super thin coaxial RF connector assemblies have been widely used in computers and peripherals thereof, communication products, as well as consumer electronics for transmission of RF signals in the micron wave bands due to their lightweight and small volume as well as the ability of transmitting RF signals in micro wave bands below 10 GHz.

A structural design of a conventional super thin coaxial RF connector assembly, as shown in FIG. 1 to FIG. 6, comprises a super thin coaxial RF wire side connector 5 and a super thin coaxial RF board side connector 3. Essentially, the super thin coaxial RF wire side connector 5 is plugged to the super thin coaxial RF board side connector 3 for transmission of an RF signal. A main body 311 of a board side center terminal 31 of the super thin coaxial RF board side connector 3 is disposed at the center of a board side shield terminal 32 thereof, and the board side center terminal 31 extends through a notch 321, which is reserved by the board side shield terminal 32, by means of a bottom extension 312, and is in electrical contact with a circuit board 4 outside the board side shield terminal 32. The board side center terminal 31 and the board side shield terminal 32 may be separated by the notch 321 to avoid a short circuit due to the electrical contact of the board side center terminal 31 and the board side shield terminal 32. However, the notch 321 of the board side shield terminal 32 would cause leakage, and result in poor electrical shield effect of the board side shield terminal 32, so that an electromagnetic coupling interference is prone to occur in the board side shield terminal 32. Accordingly, only an RF signal in a micro wave band below 10 GHz can be transmitted between the super thin coaxial RF wire side connector and the super thin coaxial RF board side connector of the conventional super thin coaxial RF board side connector assembly. As such, the requirement for transmission of 3G and 4G communication generation RF signals may be conformed to, though, the transmission capacity for transmission of UHF millimeter wave band RF signals above 30 GHz is still not available, so that the transmission requirement with respect to 5G UHF RF signals for 5G communication generation cannot be met. This is the application bottleneck to be overcome for current 5G communication generation.

Therefore, those skilled in the art desire to address issues urgently with respect to how to improve the shortages mentioned above and improve the electrical shield effect of the shield terminal of the super thin coaxial RF board side connector, so that the super thin coaxial RF connector assembly can be used for the transmission of RF signals in UHF millimeter wave bands. Therefore, structures for members of the super thin coaxial RF connector assembly are improved in the present invention to address the issue that the super thin coaxial RF connector assembly cannot transmit RF signals in UHF millimeter wave bands.

SUMMARY OF THE INVENTION

In view of the above drawbacks in the conventional technology, a primary object of the invention is to provide an ultra-high frequency super thin coaxial RF connector assembly mating a circuit substrate to transmit an RF signal, the circuit substrate comprising a substrate center terminal contact portion, including: an ultra-high frequency super thin coaxial RF board side connector comprising a board side shield terminal having a board side shield terminal plug ring; and an ultra-high frequency super thin coaxial RF wire side connector having a wire side insulator, a wire side elastic arm center terminal and a wire side shield terminal, wherein the wire side elastic arm center terminal has a wire side elastic arm center terminal body and a wire side elastic arm center terminal contact portion, the wire side elastic arm center terminal body being penetrated into the wire side insulator; the wire side shield terminal comprises a wire side shield terminal plug ring; the wire side elastic arm center terminal contact portion is exposed on a side of the wire side insulator and the wire side shield terminal insertion ring; the wire side shield terminal plug ring plugs the board side shield terminal plug ring from top to bottom, so that the wire side elastic arm center terminal contact portion passes through an interior of the board side shield terminal plug ring to have a direct electrical contact with the substrate central terminal contact portion; and the wire side elastic arm center terminal body has an elastic structure to be abutted on the substrate center terminal contact portion with an elasticity, in order to keep an abutting force applied by the wire side elastic arm center terminal contact portion to the substrate center terminal contact portion, and realize the electrical contact between the wire side elastic arm center terminal contact portion and the substrate center terminal contact portion.

In comparison to prior arts, an arrangement of an RF board side center terminal is omitted for an ultra-high frequency super thin coaxial RF connector assembly according to the present invention, for an RF signal to be capable of being transferred to a circuit board directly without the RF board side center terminal, so that no notch has to be reserved by aboard side shield terminal for a board side center terminal to pass through. Thus, the board side shield terminal in the ultra-high frequency super thin coaxial RF board side connector can provide electrical shield effectively to avoid electromagnetic coupling interference occurring in the board side shield terminal as the ultra-high frequency super thin coaxial RF connector assembly transmits a high frequency RF signal. Accordingly, the ultra-high frequency super thin coaxial RF connector assembly of the present invention is capable of transmitting RF signals in UHF millimeter wave bands. In addition, the wire side elastic arm center terminal may be in a direct electrical contact with the circuit substrate while keeping a stable contact force, to ensure that the RF signal transmitted by the wire side elastic arm center terminal can reach the circuit substrate smoothly.

BRIEF DESCRIPTION OF THE DRAWINGS

The above and other aspects, features and other advantages of the present invention will be more clearly understood from the following detailed description taken in conjunction with the accompanying drawings, in which:

FIG. 24-1 is a sectional view showing members shown in FIG. 24 taken along line BB.

FIG. 26-1 is a sectional view showing members shown in FIG. 26 taken along line CC.

FIG. 39-1 to FIG. 39-4 are schematic views showing implementations of the wire side elastic arm center terminal of ultra-high frequency super thin coaxial RF connector assembly of the present invention.

DETAILED DESCRIPTION OF THE PREFERRED EMBODIMENT

Figure 1:
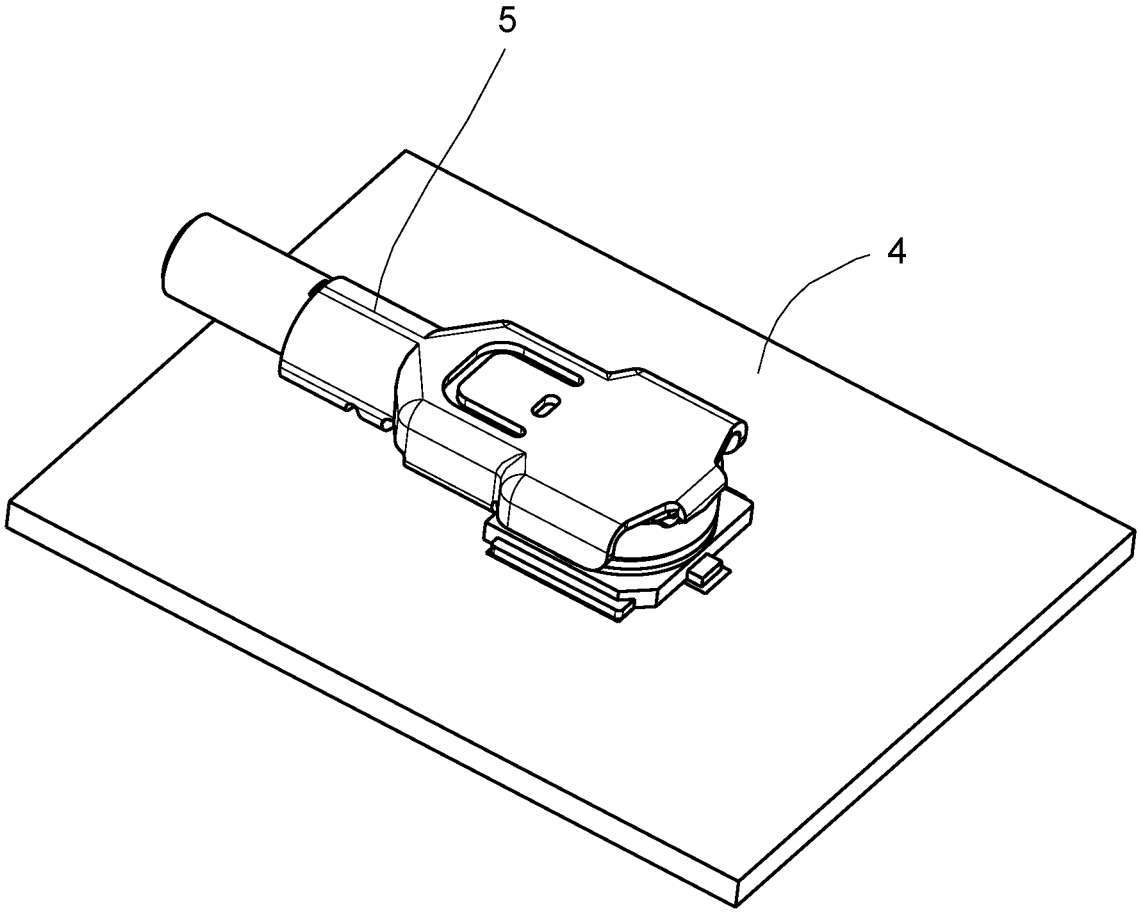
Figure 1 (Prior Art)
FIG. 1 is an assembly drawing showing a conventional super thin coaxial RF connector assembly.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

In the following, elements with the same or similar functions will be described using the same reference numerals, and the description of the same or equivalent features will be omitted for the disclosed content to be more concise and easier to be understood.

An arrangement of an RF board side center terminal is omitted for an ultra-high frequency super thin coaxial RF connector assembly according to the present invention, for an RF signal to be capable of being transferred to a circuit board directly without the RF board side center terminal, so that the board side shield terminal in the ultra-high frequency super thin coaxial RF board side connector can provide electrical shield effectively to avoid electromagnetic coupling interference occurring in the board side shield terminal as the ultra-high frequency super thin coaxial RF connector assembly transmits a high frequency RF signal. Accordingly, the ultra-high frequency super thin coaxial RF connector assembly of the present invention is capable of transmitting RF signals in UHF (Ultra-High Frequency) millimeter wave band above 30 GHz.

First Embodiment

Refer to FIG. 7 to FIG. 16 and FIG. 23 to FIG. 38 together, wherein an ultra-high frequency super thin coaxial RF connector assembly 1 includes an ultra-high frequency super thin coaxial RF wire side connector 11 and an ultra-high frequency super thin coaxial RF board side connector 12 for mating an RF coaxial cable 6 and a circuit substrate 2, respectively, to transmit RF signals in UHF millimeter wave bands above 30 GHz. The circuit board 2 comprises a substrate center terminal contact portion 21 and a substrate shield loop 22, which surrounds the substrate center terminal contact portion 21, to provide electrical shield for the substrate center terminal contact portion 21. The ultra-high frequency super thin coaxial RF wire side connector 11 mates an RF coaxial cable 6, and the RF coaxial cable 6 comprises a cable center conductor 61 and a cable shield conductor 62. The ultra-high frequency super thin coaxial RF board side connector 12 comprises a board side shield terminal 121 having a board side shield terminal plug ring 1211.

Figure 2:
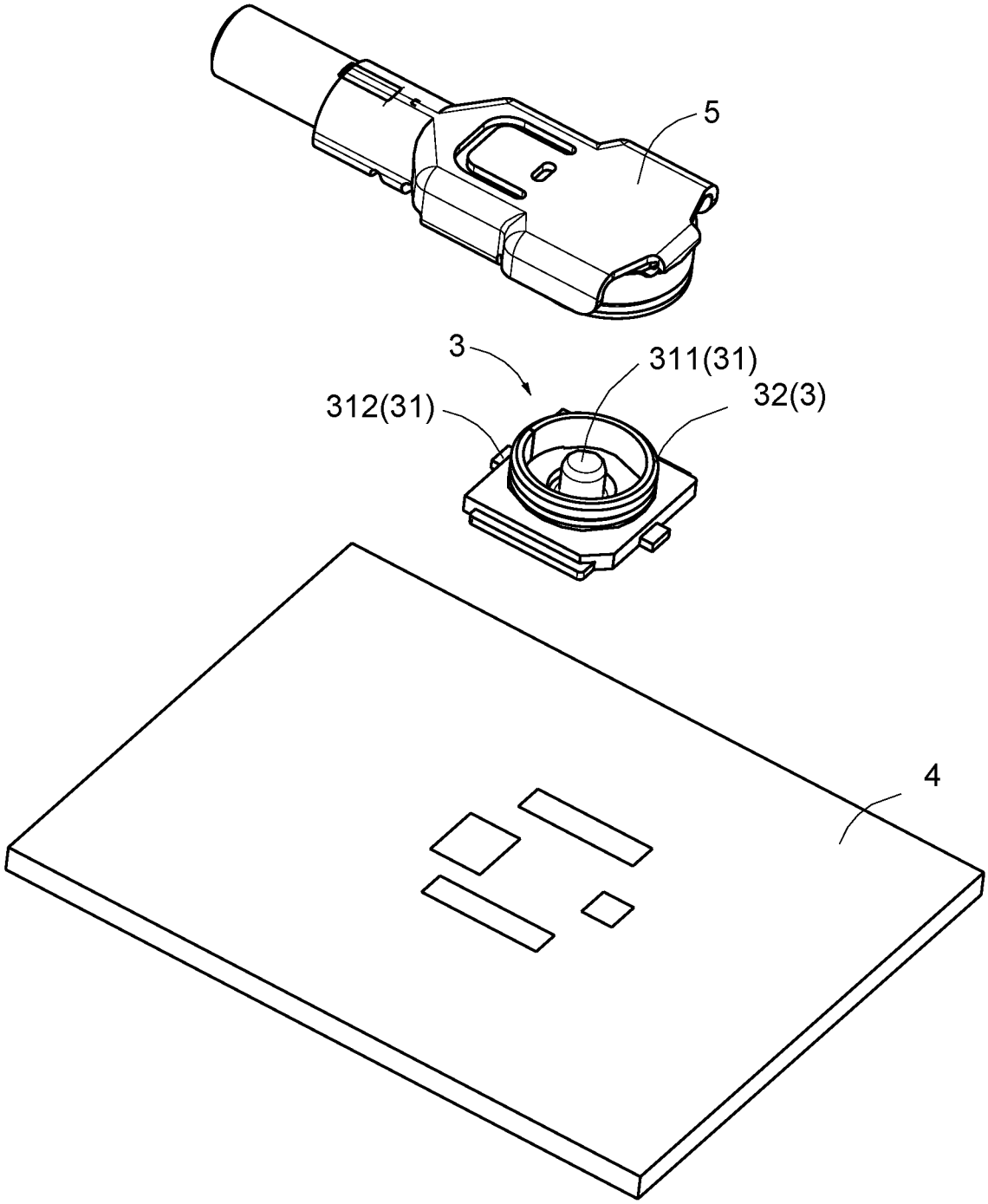
Figure 2 (Prior Art)
FIG. 2 is an exploded view showing the super thin coaxial RF connector assembly shown in FIG. 1.
Figure 3:
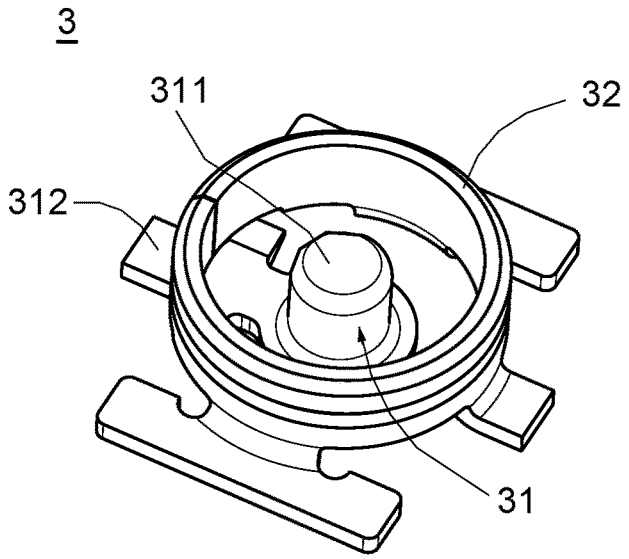
Figure 3 (Prior Art)
FIG. 3 is an assembly drawing showing the center terminal and the shield terminal of super thin coaxial RF board side connector of super thin coaxial RF connector assembly shown in FIG. 2.
Figure 4:
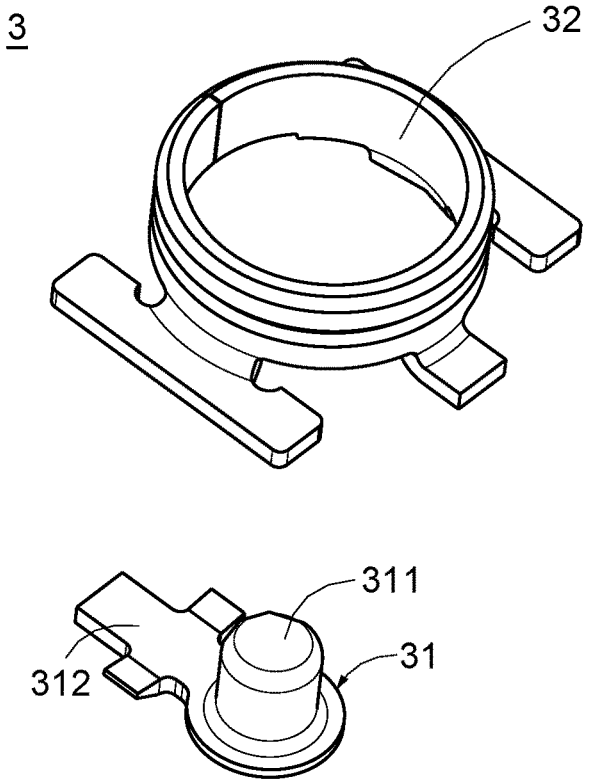
Figure 4 (Prior Art)
FIG. 4 is an exploded view showing the center terminal and the shield terminal shown in FIG. 3.
Figure 5:
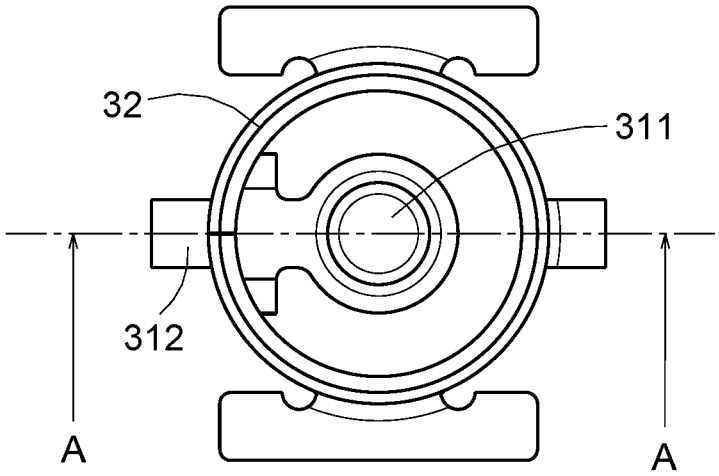
Figure 5 (Prior Art)
FIG. 5 is a top view showing the center terminal and the shield terminal shown in FIG. 3.
Figure 6:
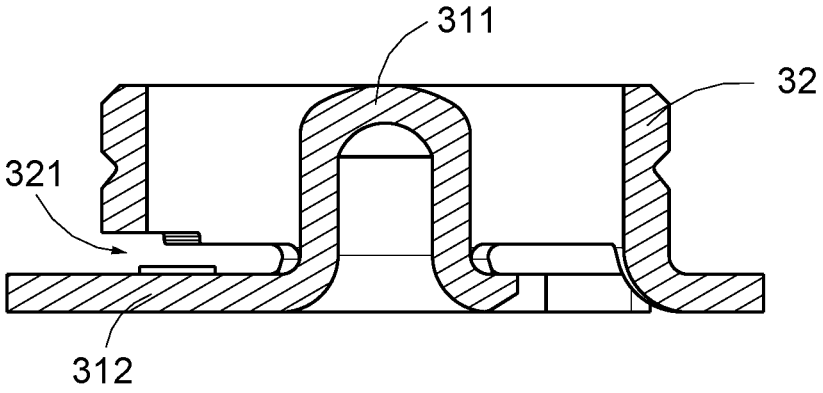
Figure 6 (Prior Art)
FIG. 6 is a sectional view showing members shown in FIG. 5 taken along line AA.
Figure 7:
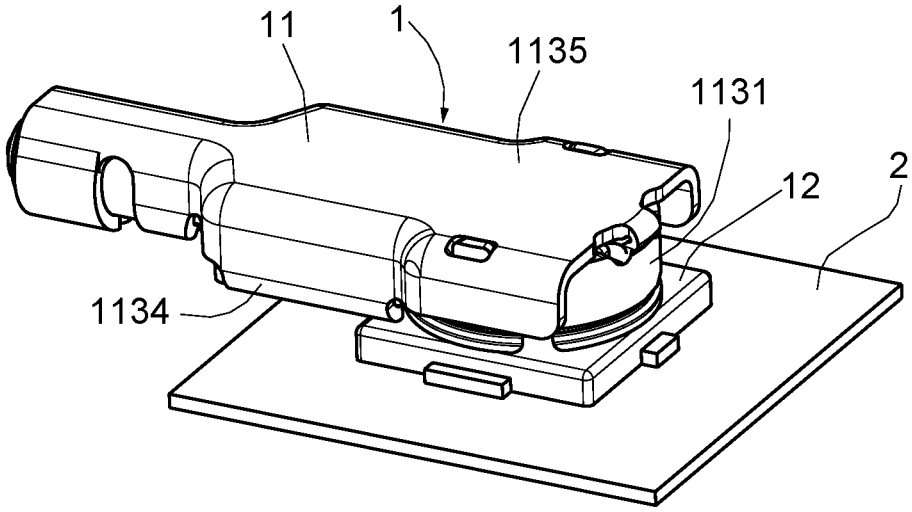
FIG. 7 is an assembly drawing showing an ultra-high frequency super thin coaxial RF connector assembly according to a first embodiment of the present invention at a first angle of view.
Figure 8:
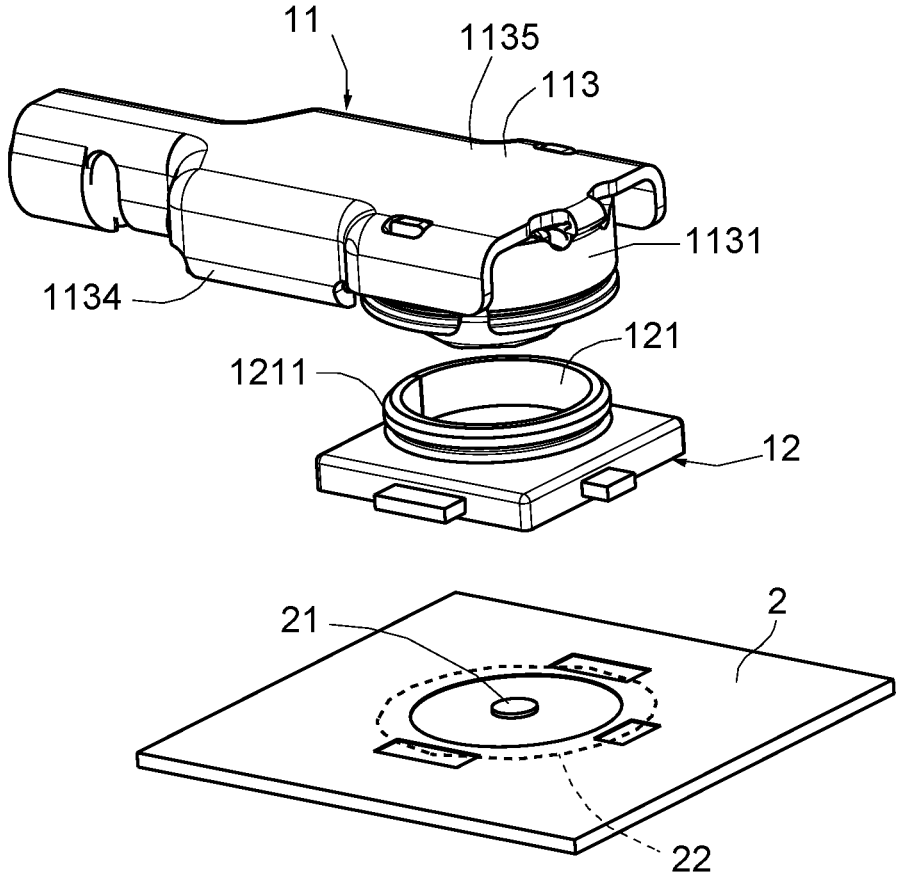
FIG. 8 is an exploded view showing the ultra-high frequency super thin coaxial RF connector assembly shown in FIG. 7.
Figure 9:
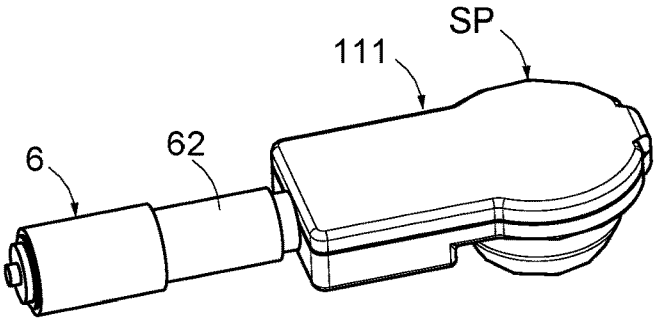
FIG. 9 is an assembly drawing showing the wire side elastic arm center terminal and the wire side insulator of the ultra-high frequency super thin coaxial RF connector shown in FIG. 8.
Figure 10:
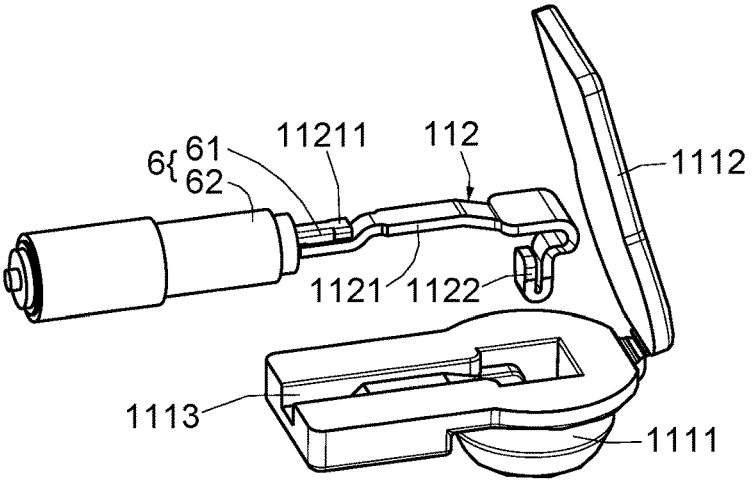
FIG. 10 is an exploded view showing the wire side elastic arm center terminal and the wire side insulator shown in FIG. 9.
Figure 11:
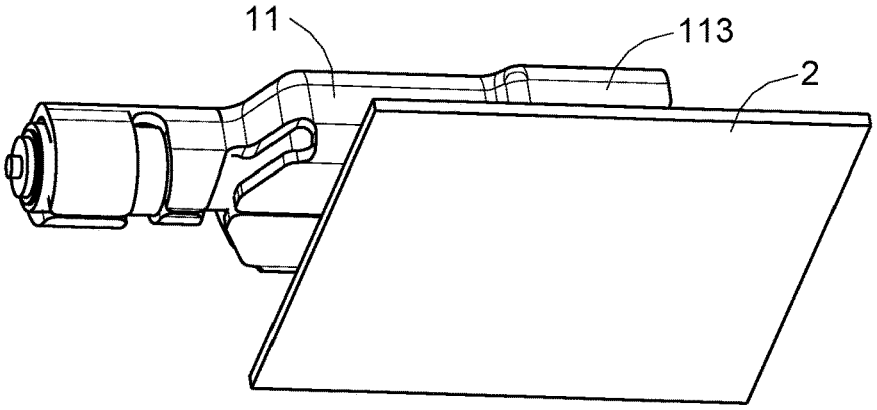
FIG. 11 is an assembly drawing showing an ultra-high frequency super thin coaxial RF connector assembly according to a first embodiment of the present invention at a second angle of view.
Figure 12:
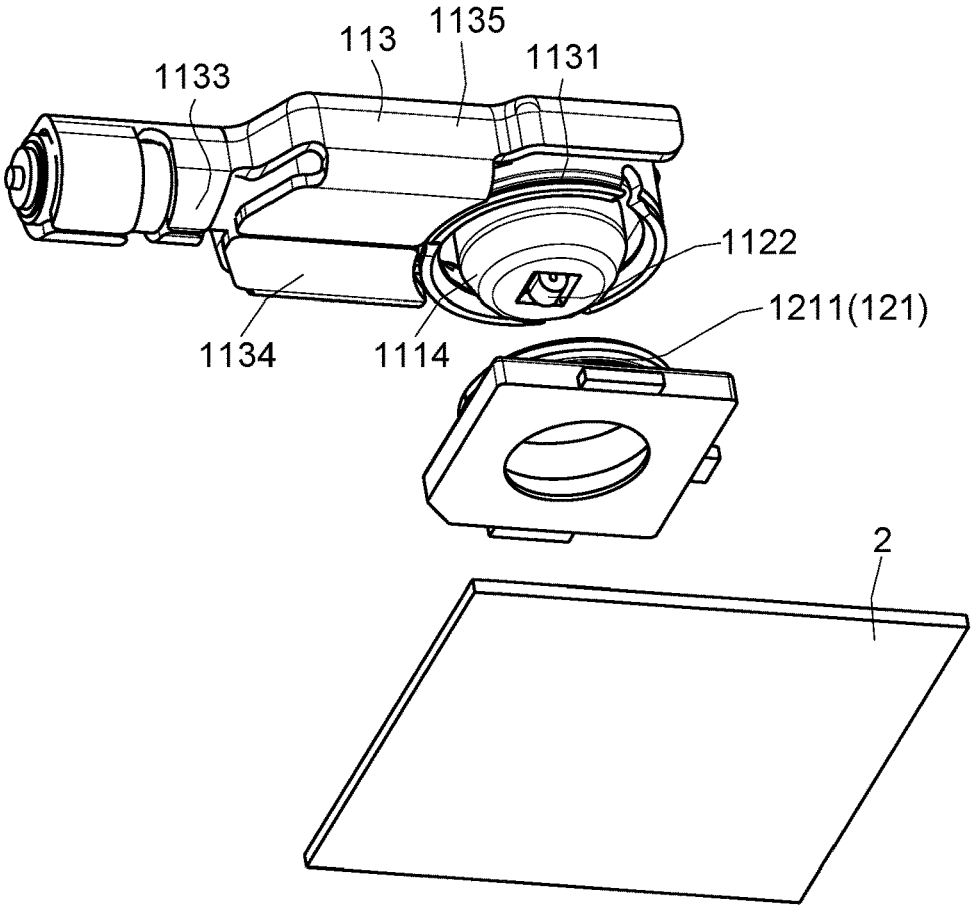
FIG. 12 is an exploded view showing the ultra-high frequency super thin coaxial RF connector assembly shown in FIG. 11.
Figure 13:
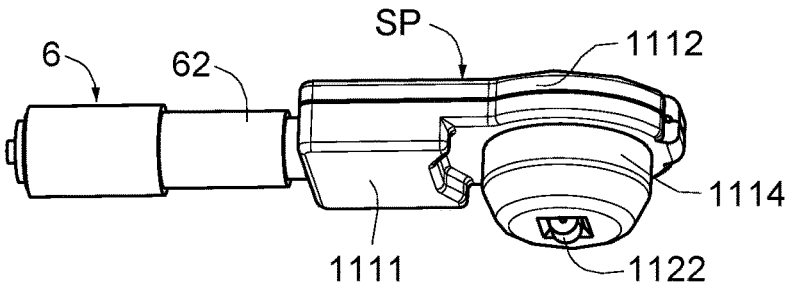
FIG. 13 is an assembly drawing showing the wire side elastic arm center terminal and the wire side insulator of the ultra-high frequency super thin coaxial RF connector shown in FIG. 11.
Figure 14:
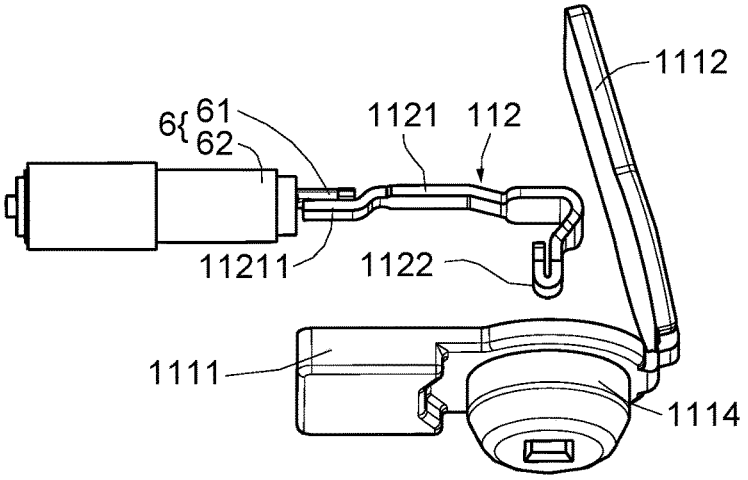
FIG. 14 is an exploded view showing the center terminal and the insulator shown in FIG. 13.
Figure 15:
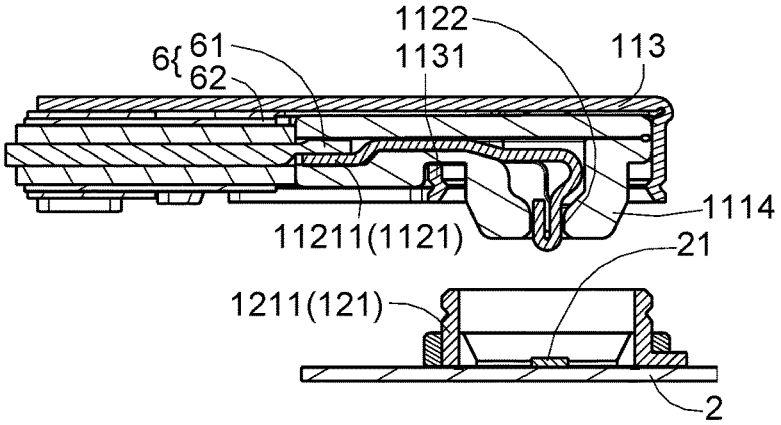
FIG. 15 is a schematic view showing an ultra-high frequency super thin coaxial RF connector assembly according to a first embodiment of the present invention in a first assembly process.
Figure 16:
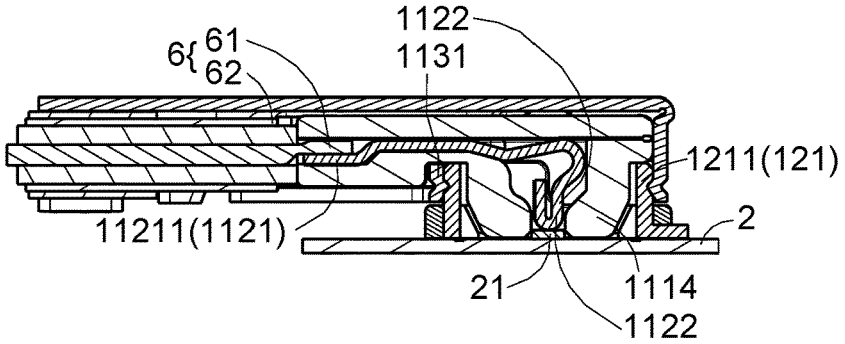
FIG. 16 is a schematic view showing an ultra-high frequency super thin coaxial RF connector assembly according to a first embodiment of the present invention in a second assembly process.
Figure 17:
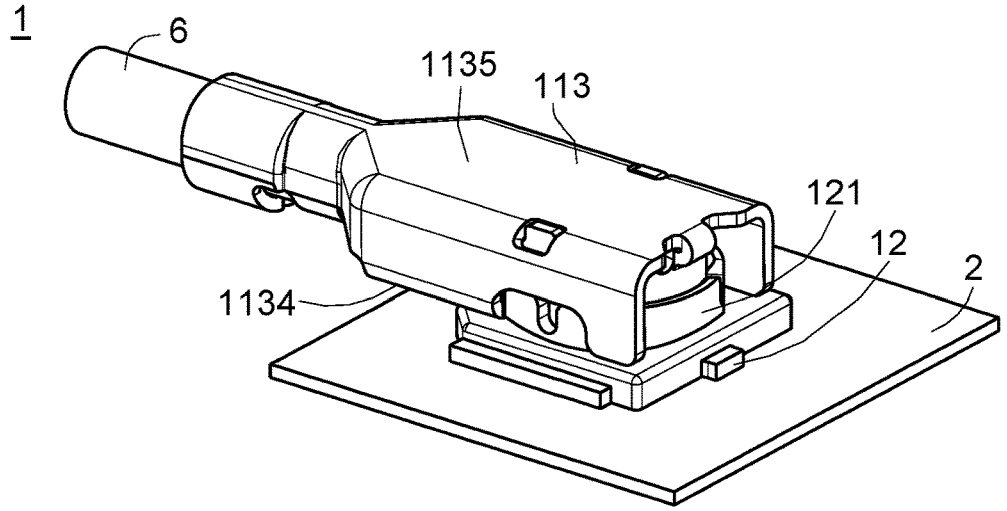
FIG. 17 is an assembly drawing showing a ultra-high frequency super thin coaxial RF connector assembly according to a second embodiment of the present invention at a first angle of view.
Figure 18:
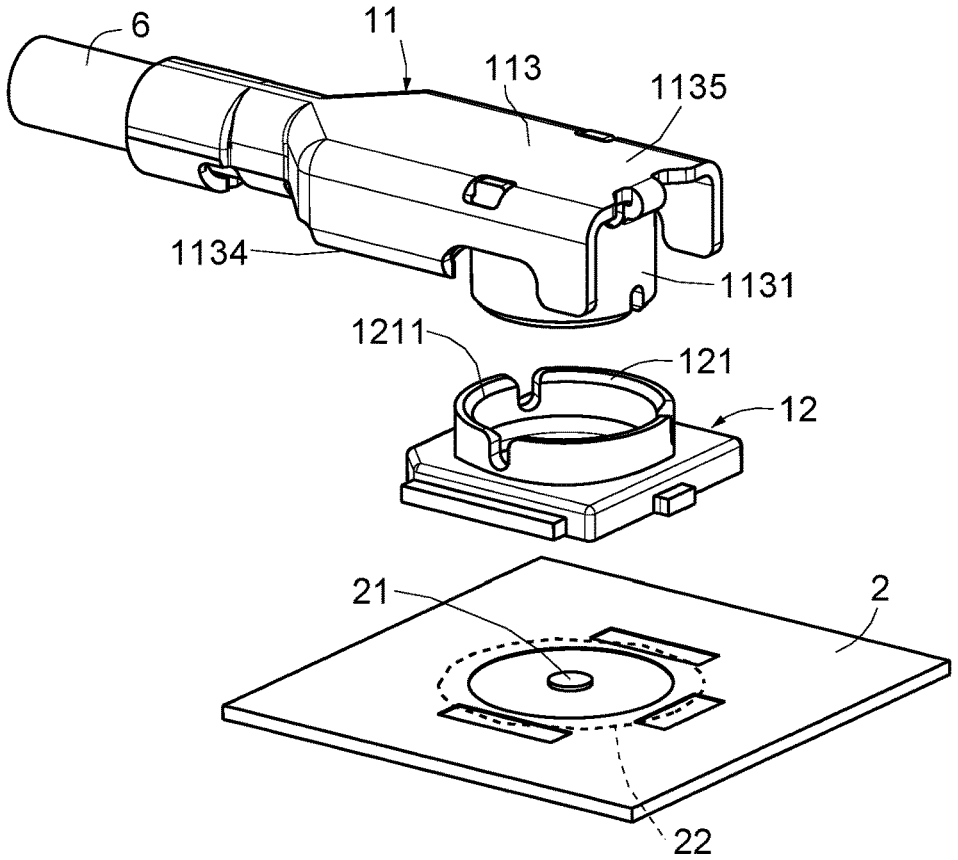
FIG. 18 is an exploded view showing the ultra-high frequency super thin coaxial RF connector assembly shown in FIG. 17.
Figure 19:
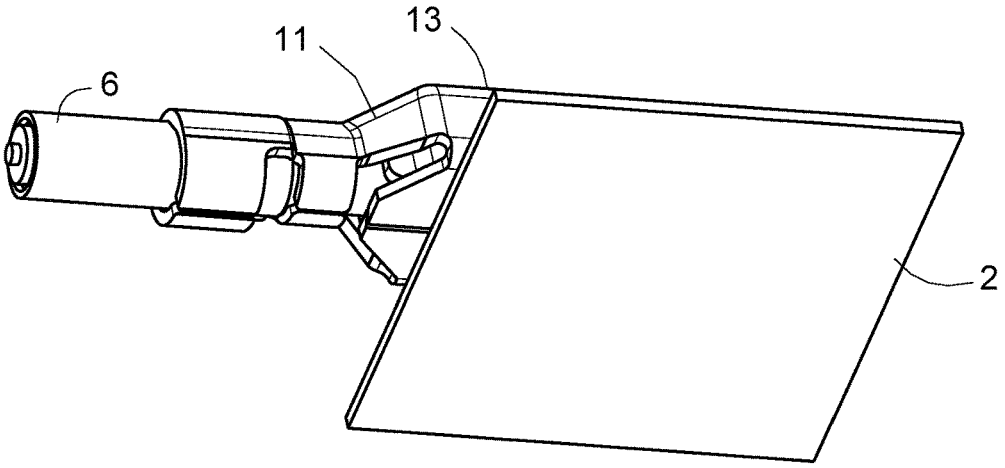
FIG. 19 is an assembly drawing showing an ultra-high frequency super thin coaxial RF connector assembly according to a second embodiment of the present invention at a second angle of view.
Figure 20:
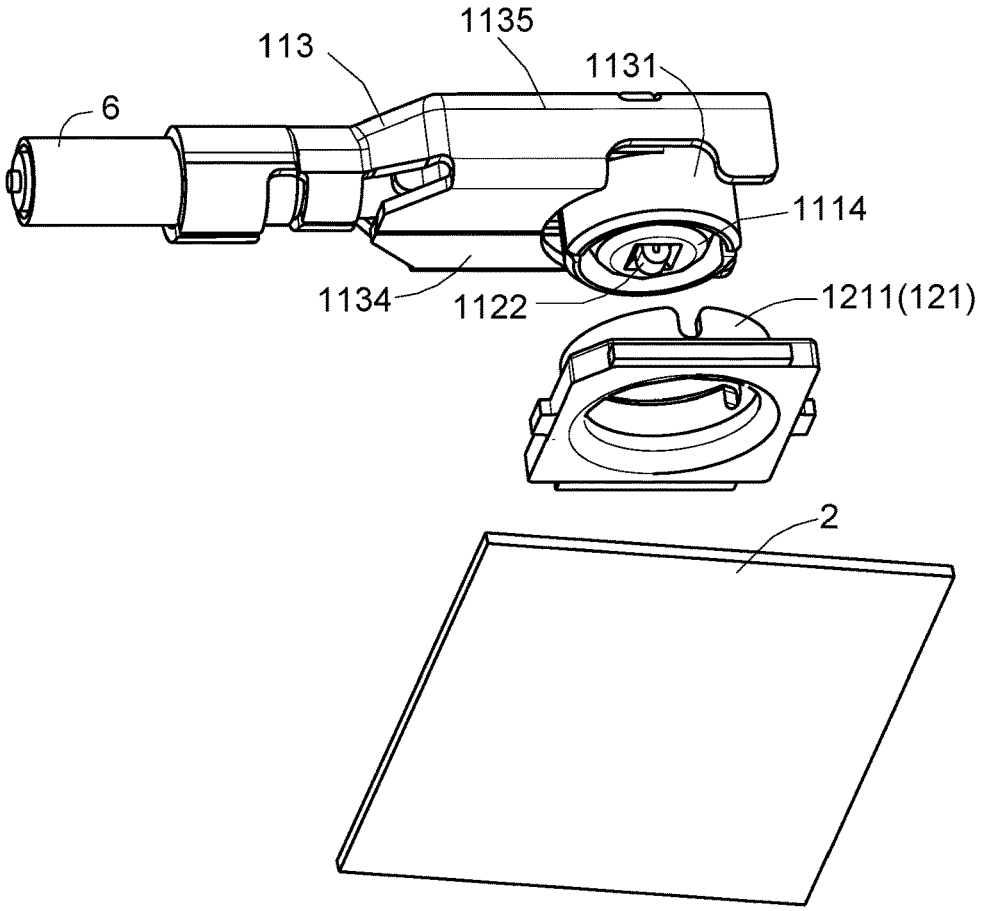
FIG. 20 is an exploded view showing the ultra-high frequency super thin coaxial RF connector assembly shown in FIG. 19.
Figure 21:
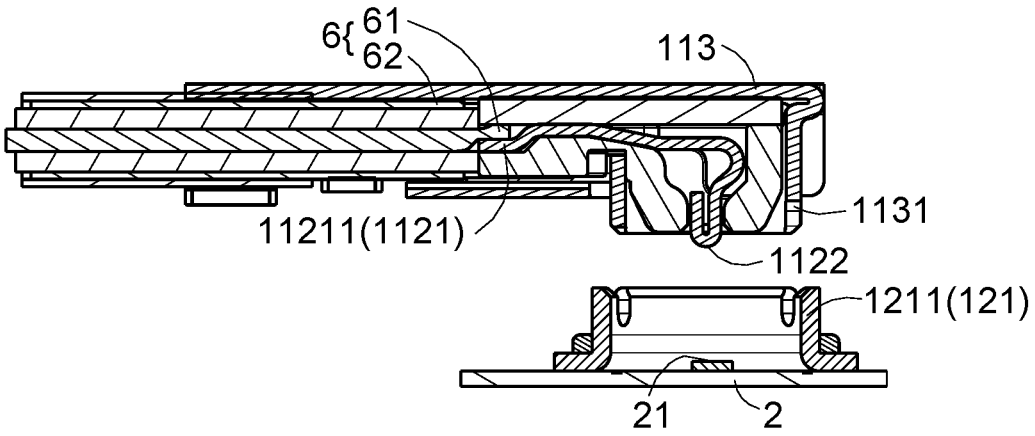
FIG. 21 is a schematic view showing an ultra-high frequency super thin coaxial RF connector assembly according to a second embodiment of the present invention in a first assembly process.
Figure 22:
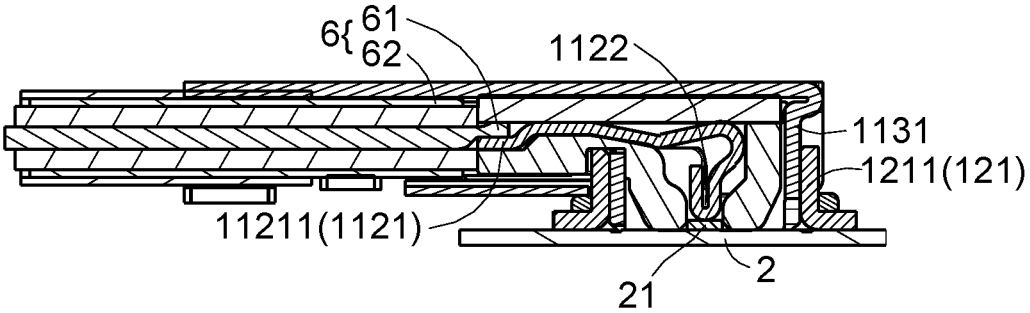
FIG. 22 is a schematic view showing an ultra-high frequency super thin coaxial RF connector assembly according to a second embodiment of the present invention in a second assembly process.
Figure 31:
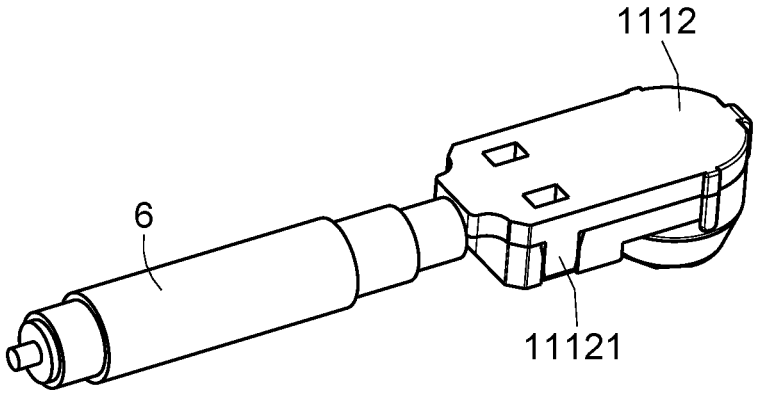
FIG. 31 is an assembly drawing showing the wire side elastic arm center terminal and the wire side insulator of the ultra-high frequency super thin coaxial RF connector shown in FIG. 28.
Figure 32:
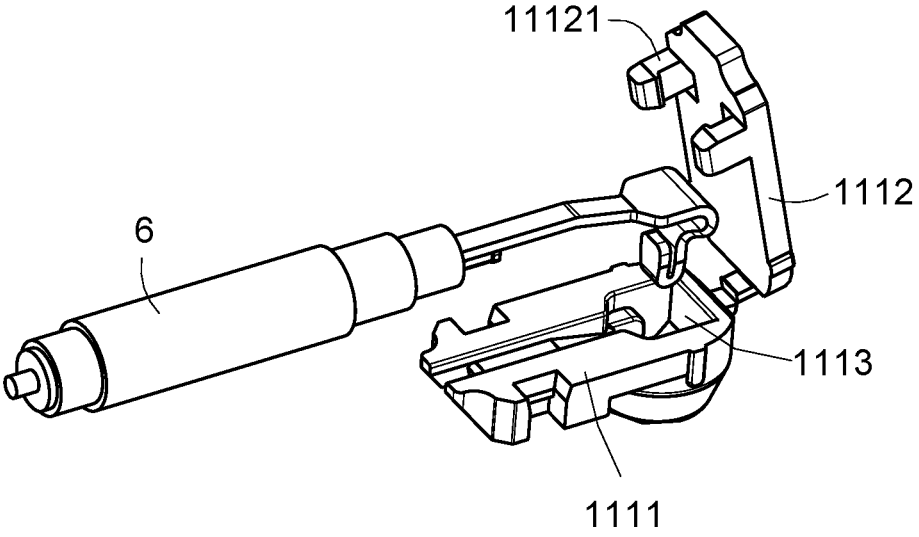
FIG. 32 is an exploded view showing the wire side elastic arm center terminal and the wire side insulator shown in FIG. 31.
Figure 33:
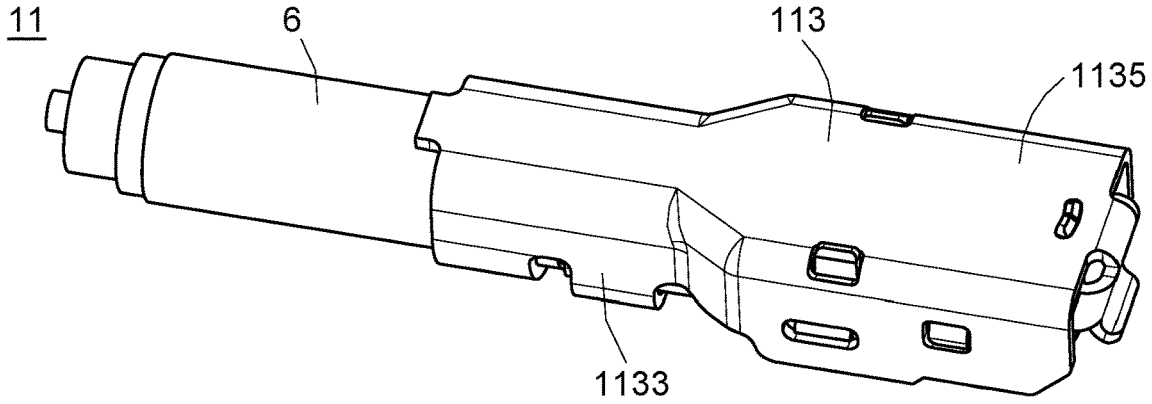
FIG. 33 is an assembly drawing showing an ultra-high frequency super thin coaxial RF connector assembly according to a second embodiment of the present invention at a first angle of view.
Figure 34:
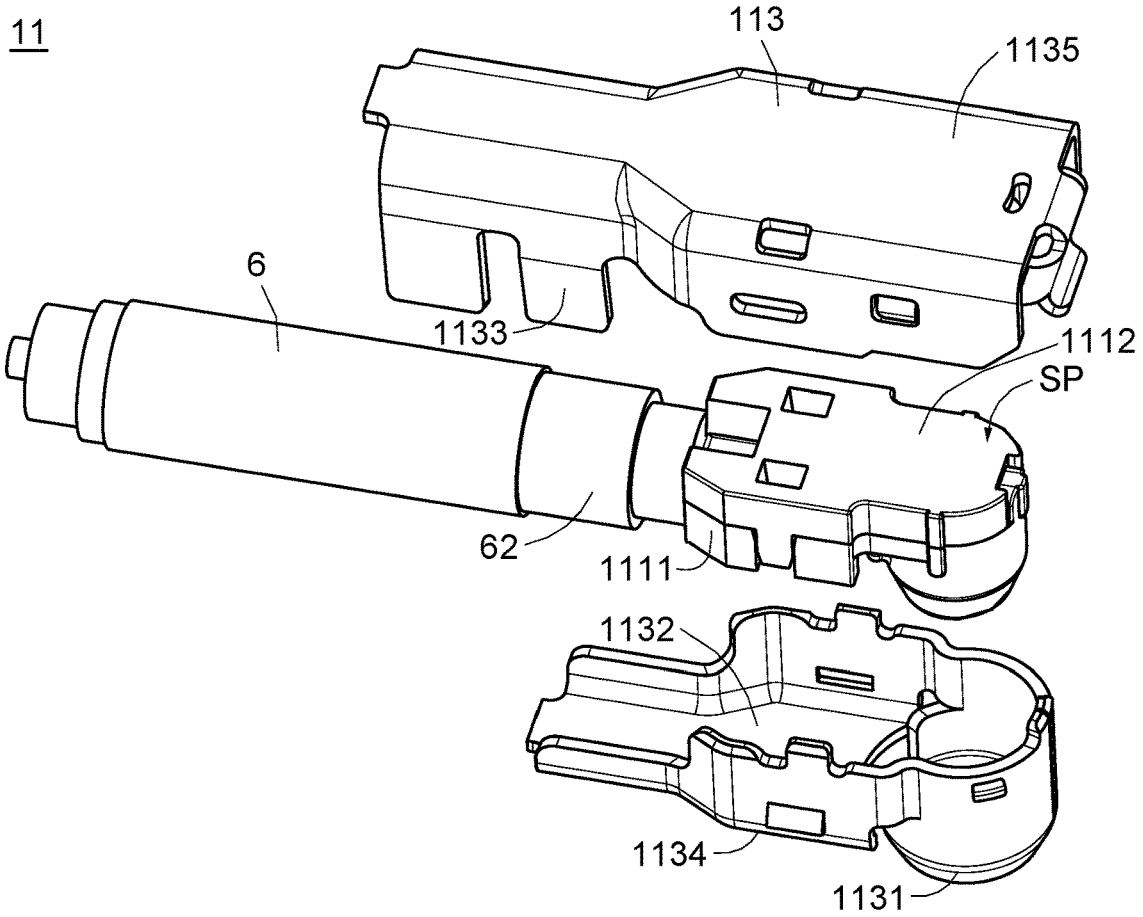
FIG. 34 is an exploded view showing the ultra-high frequency super thin coaxial RF wire side connector shown in FIG. 33.
Figure 35:
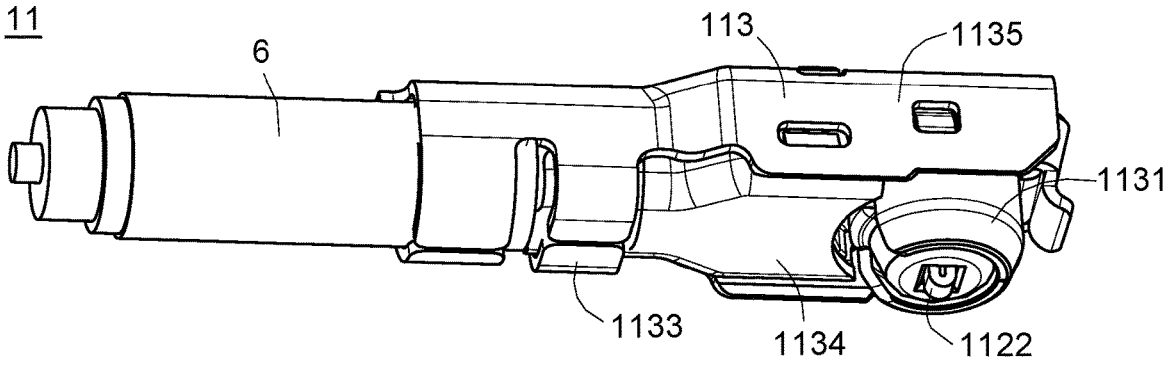
FIG. 35 is an assembly drawing showing an ultra-high frequency super thin coaxial RF connector assembly according to a second embodiment of the present invention at a second angle of view.
Figure 37:
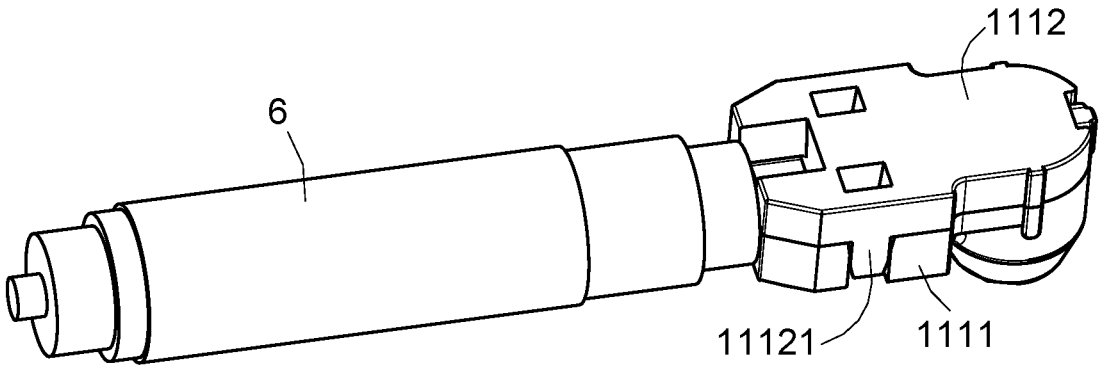
FIG. 37 is an assembly drawing showing the wire side elastic arm center terminal and the wire side insulator of the ultra-high frequency super thin coaxial RF connector shown in FIG. 34.
Figure 38:
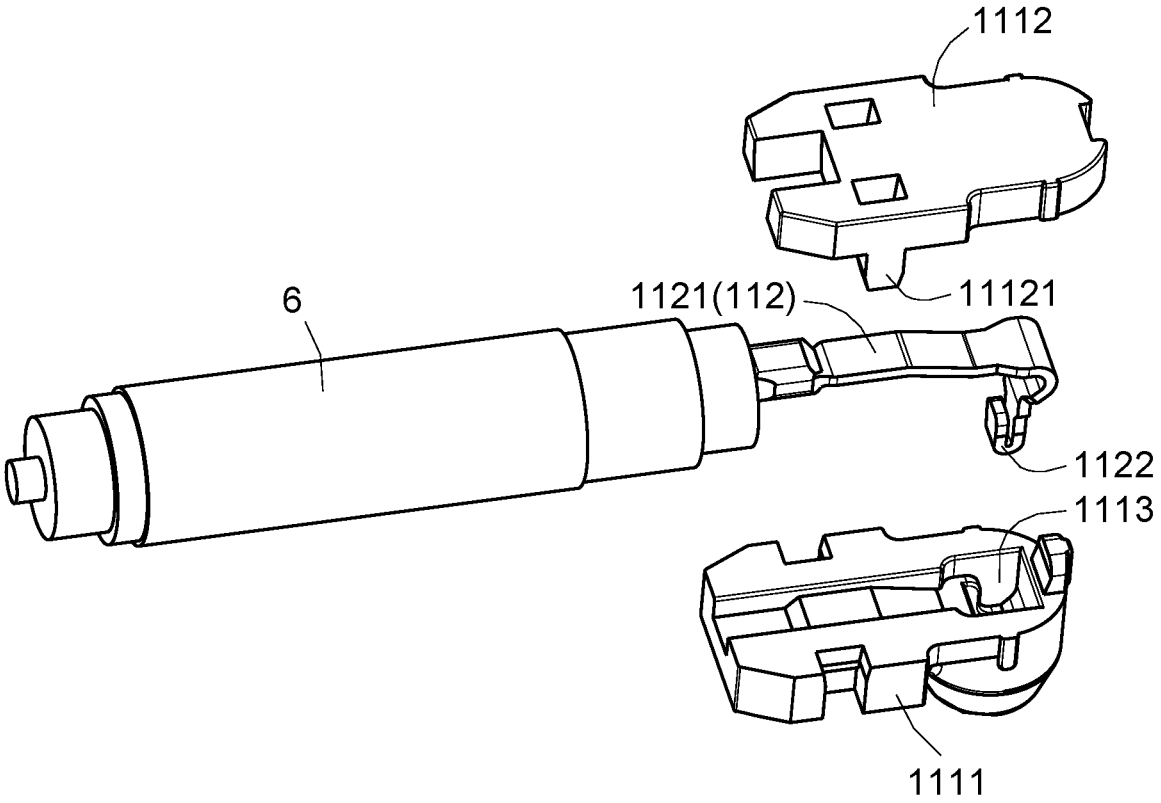
FIG. 38 is exploded view showing the wire side elastic arm center terminal and the wire side insulator shown in FIG. 37.
Figures 1, 39:
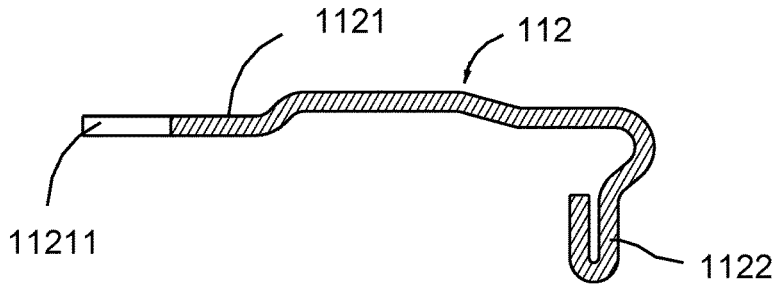
Figures 2, 39:
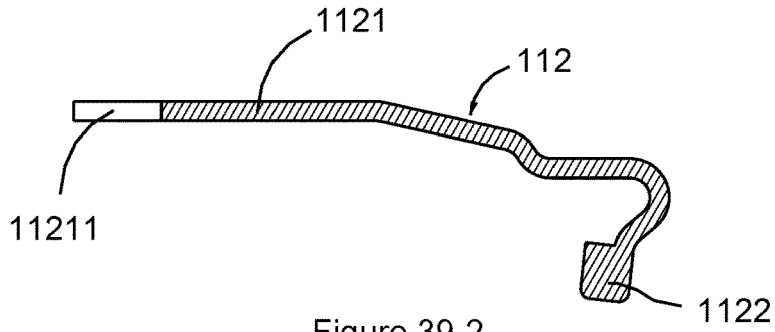
Figures 3, 39:
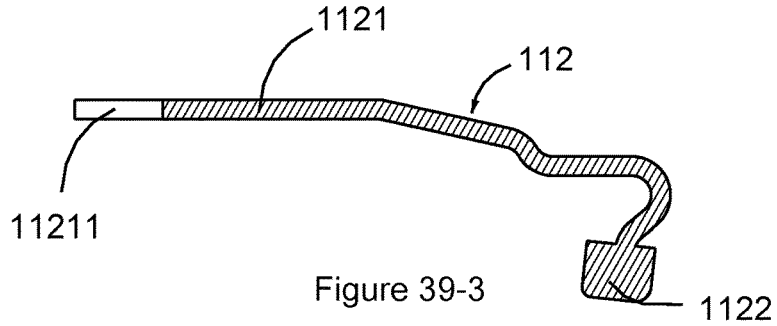
Figures 4, 39:
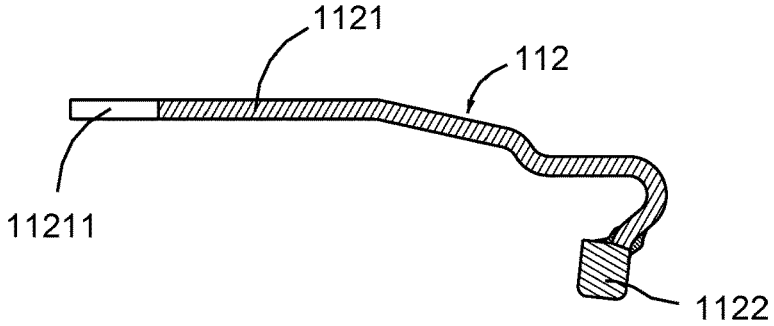

The ultra-high frequency super thin coaxial RF wire side connector 11 has a wire side insulator 111, a wire side elastic arm center terminal 112, and a wire side shield terminal 113. The wire side elastic arm center terminal 112 may join the cable center conductor 61 of the RF coaxial cable 6, and has a wire side elastic arm center terminal body 1121 and a wire side elastic arm center terminal contact portion 1122. Referring to FIG. 39-1 to FIG. 39-4 together, the wire side elastic arm center terminal body 1121 and the wire side elastic arm center terminal contact portion 1122 are formed integrally (as shown in FIG. 39-1 to FIG. 39-3) or formed separately (as shown in FIG. 39-4), and the cross sectional area of the wire side elastic arm center terminal contact portion 1122 is larger than that of the wire side elastic arm center terminal body 1121. Preferably, as shown in FIG. 39-1, the wire side elastic arm center terminal contact portion 1122 is formed by bending one end of the wire side elastic arm center terminal body 1121; as shown in FIG. 39-2 to FIG. 39-3, the wire side elastic arm center terminal contact portion 1122 is formed by deforming the wire side elastic arm center terminal body 1121 using rolling or extrusion. The wire side shield terminal 113 may join the cable shield conductor 62 of the RF coaxial cable 6. The wire side insulator 111 has a wire side insulator body 1111, a wire side insulator upper cover 1112 and a wire side insulator accommodating space 1113, which is located in the wire side insulator body 1111. The wire side insulator upper cover 1112 may be flipped upward as shown in FIG. 14 and FIG. 32, or moved upward relative to the wire side insulator body 1111 as shown in FIG. 38, so that the wire side insulator accommodating space 1113 is exposed, for the wire side elastic arm center terminal body 1121 to be placed in the wire side insulator accommodation space 1113. The wire side insulator upper cover 1112 may also be flipped downward relative to the wire side insulator body 1111 as shown in FIG. 13 and FIG. 31, or moved downward relative to the wire side insulator body as shown in FIG. 37, for the wire side insulator accommodating space 1113 to be shielded, so that the wire side elastic arm center terminal body 1121 is confined in the wire side insulator accommodating space 1113, such that the wire side insulator 111 and the wire side elastic arm center terminal 112 constitute an ultra-high frequency super thin coaxial RF wire side connector semi-finished product SP. In addition, as shown in FIG. 31 and FIG. 37, the wire side insulator upper cover 1112 has a wire side insulator upper cover fastening structure 11121 for fastening the wire side insulator body 1111 to complete the positioning of the wire side insulator upper cover 1112.

Figure 23:
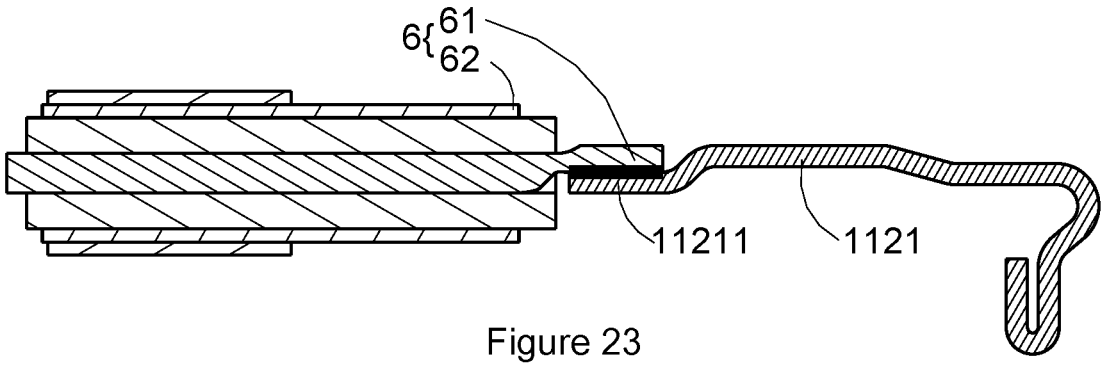
FIG. 23 is a schematic view showing a wire side elastic arm center terminal of an ultra-high frequency super thin coaxial RF connector assembly of the present invention joining a cable center conductor contact portion by welding.
Figure 24:
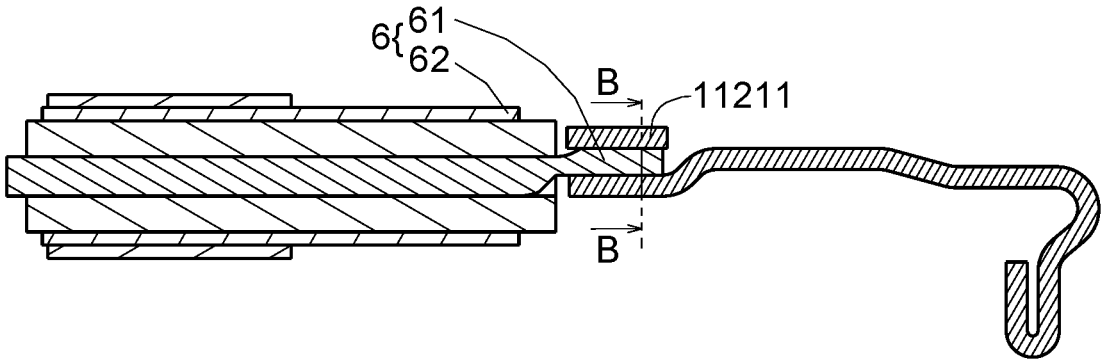
FIG. 24 is a schematic view showing a wire side elastic arm center terminal of an ultra-high frequency super thin coaxial RF connector assembly of the present invention joining a cable center conductor contact portion by crimping.
Figures 1, 24:
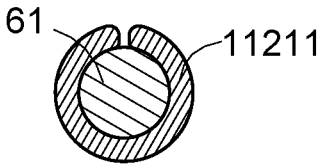
Figure 25:
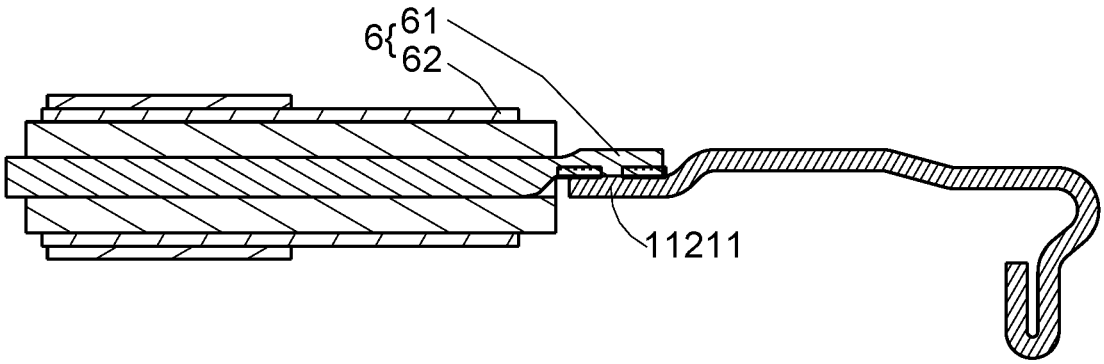
FIG. 25 is a schematic view showing a wire side elastic arm center terminal of an ultra-high frequency super thin coaxial RF connector assembly of the present invention joining a cable center conductor contact portion by pressure welding.
Figure 26:
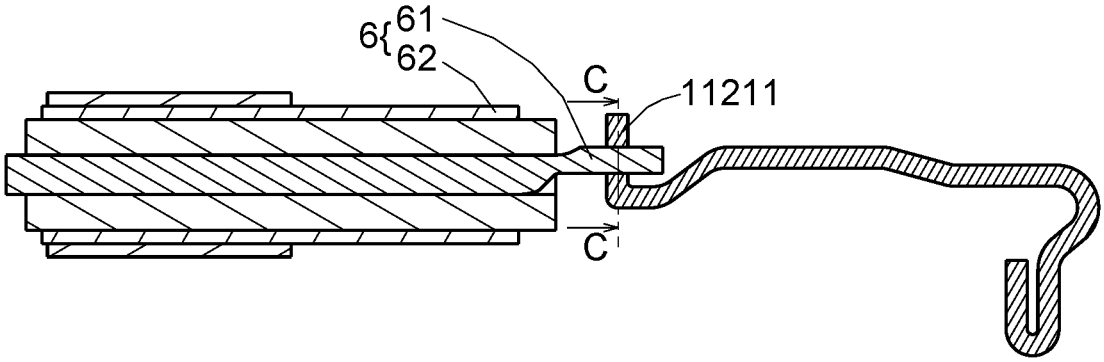
FIG. 26 is a schematic views showing a wire side elastic arm center terminal of an ultra-high frequency super thin coaxial RF connector assembly of the present invention joining a cable center conductor contact portion by IDC.
Figures 1, 26:
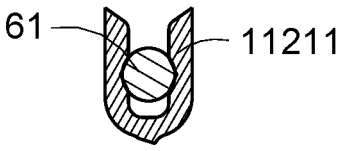
Figure 27:
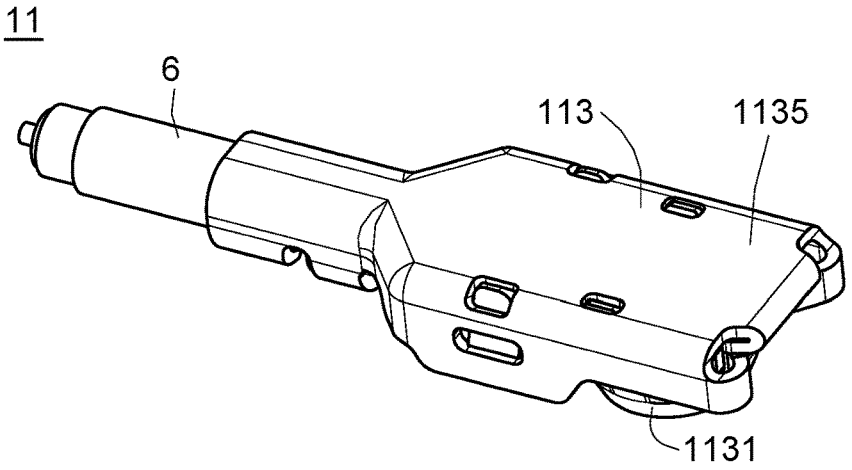
FIG. 27 is an assembly drawing showing an ultra-high frequency super thin coaxial RF wire side connector according to a second embodiment of the present invention at a first angle of view.
Figure 28:
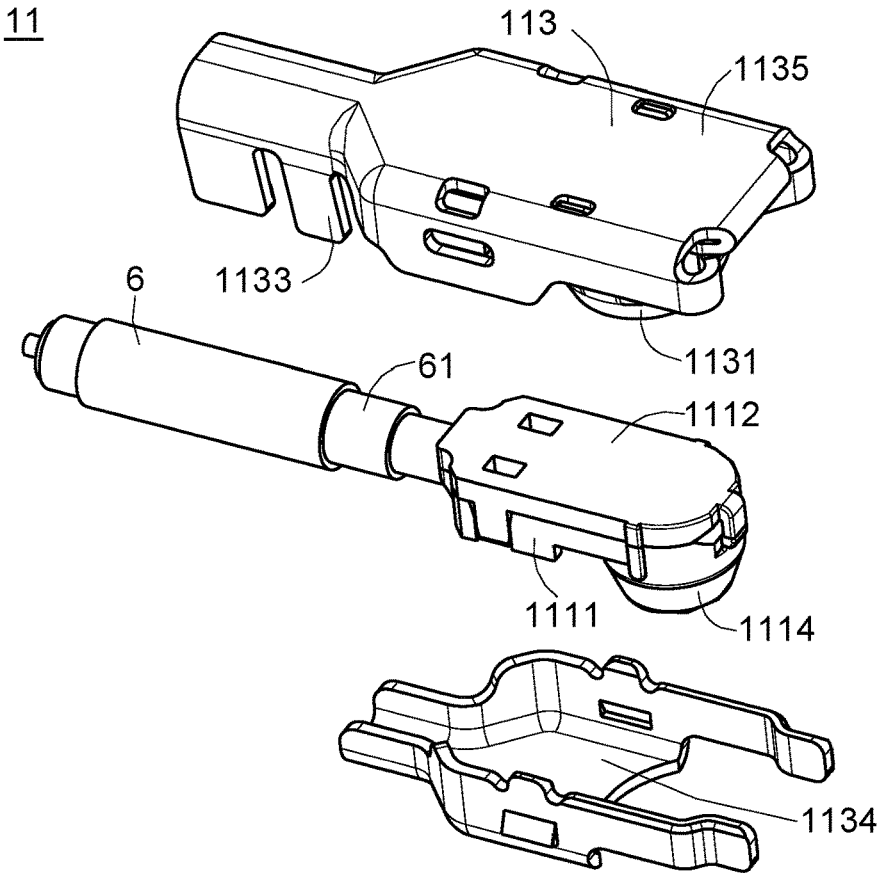
FIG. 28 is an exploded view showing the ultra-high frequency super thin coaxial RF wire side connector shown in FIG. 27.
Figure 29:
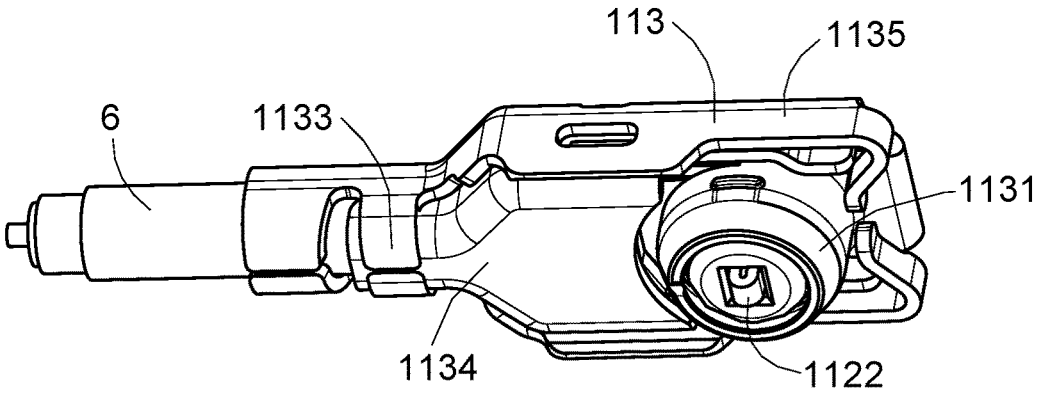
FIG. 29 is an assembly drawing showing an ultra-high frequency super thin coaxial RF wire side connector according to a first embodiment of the present invention at a second angle of view.

The wire side elastic arm center terminal body 1121 is a cantilever terminal penetrated into the wire side insulator 111. A tail portion of the cantilever terminal has a wire side elastic arm center terminal joint portion 11211. The wire side elastic arm center terminal joint portion 11211 may join the cable center conductor 61 of the RF coaxial cable 6 by means of welding (as shown in FIG. 23), crimping (as shown in FIG. 24 and FIG. 24-1), pressure welding (as shown in FIG. 25) or IDC (as shown in FIG. 26 and FIG. 26-1), etc. selectively, to receive RF signals from the cable center conductor 61.

Figure 30:
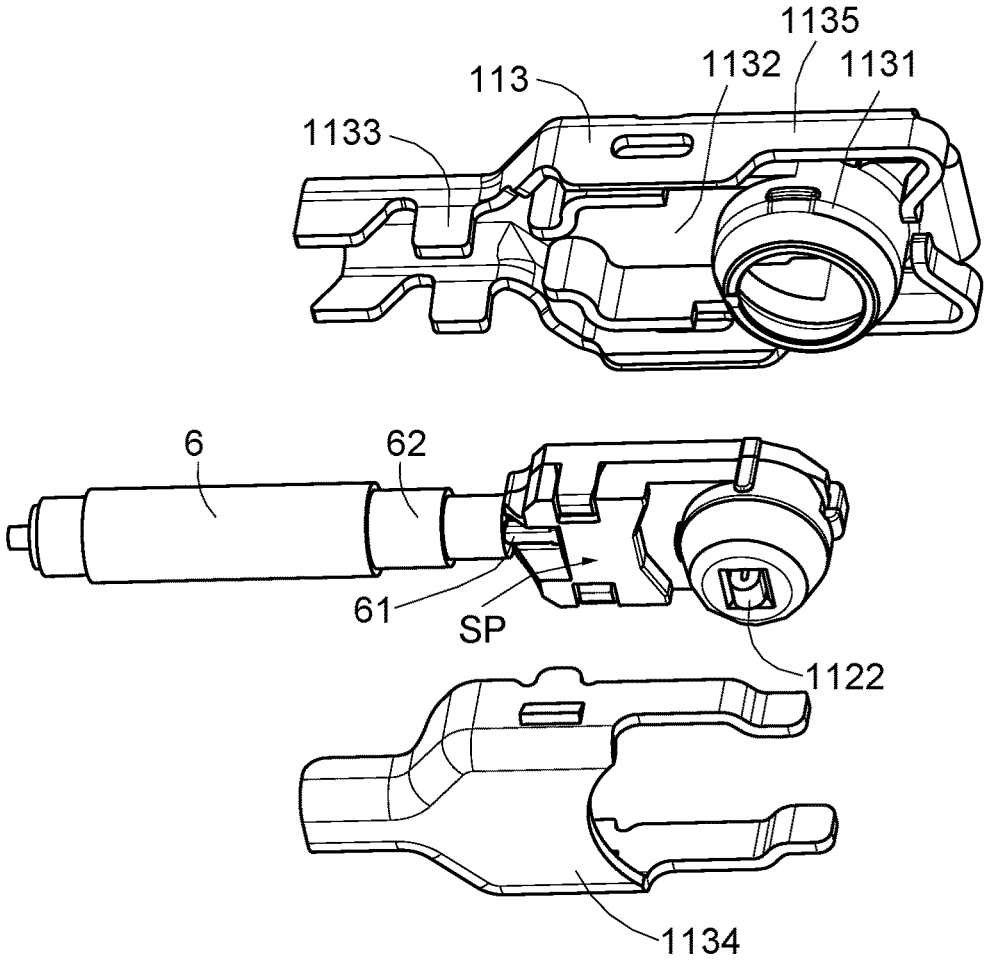
FIG. 30 is an exploded view showing the ultra-high frequency super thin coaxial RF wire side connector shown in FIG. 29.
Figure 36:
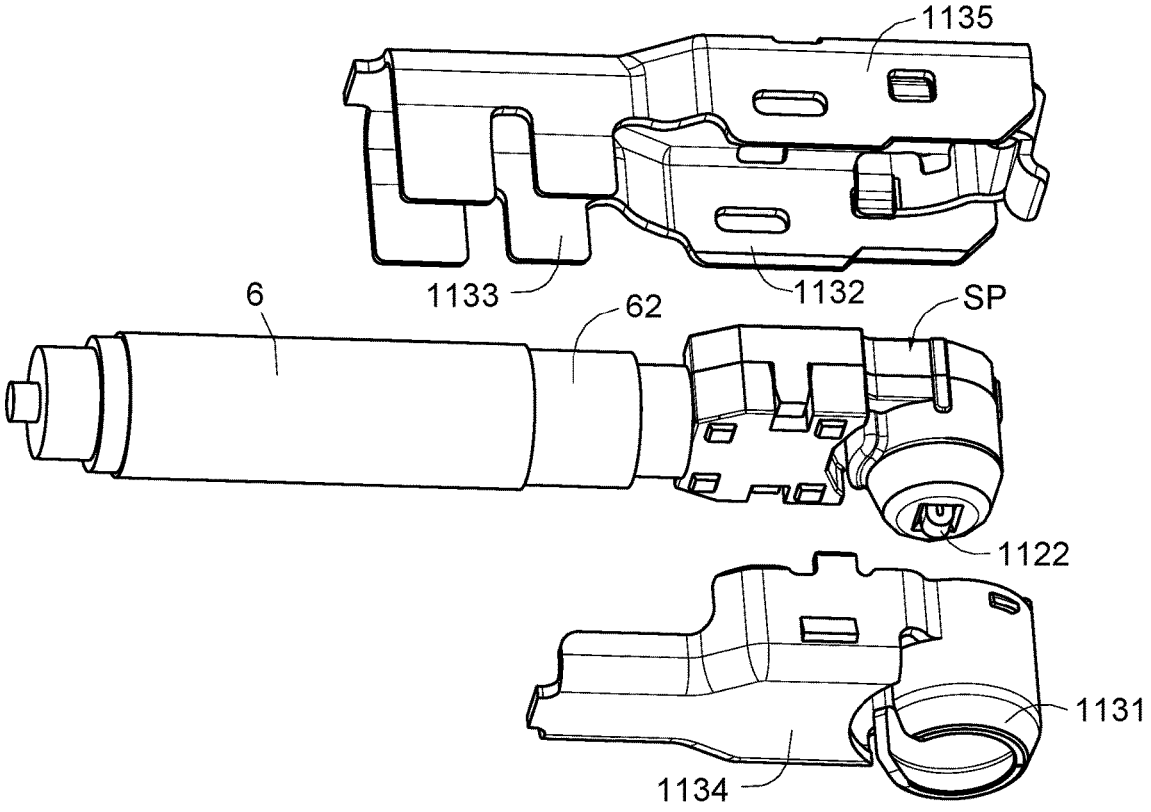
FIG. 36 is an exploded view showing the ultra-high frequency super thin coaxial RF wire side connector shown in FIG. 35.

As shown in FIG. 27 to FIG. 30 and FIG. 33 to FIG. 36, the wire side shield terminal 113 comprises a wire side shield terminal plug ring 1131, a wire side shield terminal accommodating space 1132, a wire side shield terminal joint portion 1133, a wire side shield terminal cover 1134 and a wire side shield terminal body 1135. The wire side shield terminal accommodating space 1132 is used for accommodating the ultra-high frequency super thin coaxial RF wire side connector semi-finished product SP. The wire side shield terminal cover 1134 joins the wire side shield terminal body 1135 in a manner of fastening, for example, for the ultra-high frequency super thin coaxial RF wire side connector semi-finished product SP to be confined in the wire side shield terminal accommodating space. Preferably, the wire side shield terminal plug ring 1131 is provided at the wire side shield terminal body 1135 as shown in FIG. 30 or at the wire side shield terminal cover 1134 as shown in FIG. 36. Preferably, the wire side shield terminal cover 1134 may be formed with the wire side shield terminal body 1135 integrally as shown in FIG. 30, and abuts the ultra-high frequency super thin coaxial RF wire side connector semi-finished product SP by means of bending, for the ultra-high frequency super thin coaxial RF wire side connector semi-finished product SP to be confined in the wire side shield terminal accommodating space 1132.

The wire side shield terminal joint portion 1133 joins the cable shield conductor 62 of the RF coaxial cable 6. The wire side elastic arm center terminal contact portion 1122 is exposed on one side of the wire side insulator 111 and the wire side shield terminal plug ring 1131. When the wire side shield terminal plug ring 1131 plugs the board side shield terminal plug ring 1211 from top to bottom, the wire side elastic arm center terminal contact portion 1122 may pass through an interior of the board side shield terminal plug ring 1211 to be in direct electrical contact with the substrate center terminal contact portion 21 because the ultra-high frequency super thin coaxial RF board side connector 12 is not provided with the board side center terminal, to ensure that RF signals transmitted by the wire side elastic arm center terminal body 1121 can reach the circuit board 2 smoothly without the need of a penetration notch reserved by a conventional super thin coaxial RF board side connector shield terminal for the board side center terminal, so that the electrical shield effect of the board side shield terminal 121 is improved. Accordingly, the ultra-high frequency super thin coaxial RF connector assembly 1 of the present invention may be used to transmit RF signals in UHF millimeter wave bands above 30 GHz.

In this embodiment, the board side shield terminal 121 is in electrical contact with the substrate shielding loop 22, for the wire side shield terminal 113, the board side shield terminal 121 and the substrate shield loop 22 to be in electrical communication and form a shield environment, in order to provide electrical shield for the wire side elastic arm center terminal contact portion 1122 and the substrate center terminal contact portion 21.

The board side shield terminal plug ring 1211 and the wire side shield terminal plug ring 1131 are both circular annular bodies, so that the board side shield terminal plug ring 1121 and the wire side shield terminal plug ring 1131 can be rotated relatively, in order for adjusting the relative angle of the ultra-high frequency super thin coaxial RF wire side connector 11 and the ultra-high frequency super thin coaxial RF board side connector 12 in the ultra-high frequency super thin coaxial RF connector assembly 1 to adapt the mated circuit board 2.

For inner diameters of plug rings, the wire side shield terminal plug ring 1131 is larger than the board side shield terminal plug ring 1211. Since the volume of the ultra-high frequency super thin coaxial RF board side connector 12 is too small, the wire side shield terminal plug ring 1131 will block the board side shield terminal plug ring 1211 to cause blind plug during fastening of the ultra-high frequency super thin coaxial RF wire side connector 11 and the ultra-high frequency super thin coaxial RF board side connector 12 if the wire side shield terminal plug ring is larger than the board side shield terminal plug ring, such that the position of the board side shield terminal plug ring 1211 cannot be identified with naked eyes. As such, when the wire side shield terminal plug ring 1131 plugs the board side shield terminal plug ring 1211 from top to bottom, the wire side shield terminal plug ring 1131 might extrude the board side shield terminal plug ring 1211 to cause damage without anticipation of misalignment. In this regard, the wire side insulator 111 is provided with a guiding post 1114 at a plug end additionally, and the guiding post 1114 extends outward from the interior of the wire side shield terminal plug ring 1131 to result in a guiding structure. Moreover, during the wire side shield terminal plug ring 1131 plugs the board side shield terminal plug ring 1211, the wire side shield terminal plug ring 1131 is guided to be in alignment with the board side shield terminal plug ring 1211, for the wire side shield terminal plug ring 1131 to be plugged into the board side shield terminal plug ring 1211 smoothly in the case of blind plug, so that the wire side elastic arm center terminal contact portion 1122 can get close to the substrate center terminal contact portion 21 to ensure that the wire side elastic arm center terminal contact portion 1122 can be in electrical contact with the substrate center terminal contact portion 21.

In this embodiment, when the wire side insulator upper cover 1112 is flipped downward or moved downward to shield the wire side insulator accommodating space 1113, the wire side insulator upper cover 1112 of the wire side insulator 111 may push against the wire side elastic arm center terminal body 1121, such that the wire side elastic arm center terminal body 1121 is formed as, for example, an elastic structure of an elastic cantilever, by which elastic abutting is provided for the substrate center terminal contact portion 21, in order to keep an abutting force applied by the wire side elastic arm center terminal contact portion 1122 to the substrate center terminal contact portion 21, and realize a stable electrical contact between the wire side elastic arm center terminal contact portion 1122 and the substrate center terminal contact portion 21.

Second Embodiment

Refer to FIGS. 17-22 together, wherein, as shown in the referenced drawings, the biggest difference between the second embodiment and the first embodiment is that the wire side shield terminal plug ring 1131 is smaller than the board side shield terminal plug ring 1211 with respect to inner diameters of plug rings in the second embodiment, and the board side shield terminal plug ring 1211 is in a visible state for the wire side shield terminal plug ring 1131 to be aligned with during the wire side terminal plug ring 1131 plugs the board side shield terminal plug ring 1211, in order for the wire side shield terminal plug ring 1131 to be capable of being plugged into the interior of the board side shield terminal plug ring 1211 in the case of none-blind plug, to prevent the wire side shield terminal plug ring 1131 from extruding the board side shield terminal plug ring 1211 to cause damage in the process from top to bottom without anticipation of misalignment, so that the wire side elastic arm center terminal contact portion 1122 can get close to the substrate center terminal contact portion 21 to ensure that the wire side elastic arm center terminal contact portion 1122 can be in electrical contact with the substrate center terminal contact portion 21.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A ultra-high frequency super thin coaxial RF connector assembly mating a circuit substrate to transmit an RF signal, the circuit substrate comprising a substrate center terminal contact portion, including:

an ultra-high frequency super thin coaxial RF board side connector comprising a board side shield terminal having a board side shield terminal plug ring; and an ultra-high frequency super thin coaxial RF wire side connector having a wire side insulator, a wire side elastic arm center terminal and a wire side shield terminal, wherein the wire side elastic arm center terminal has a wire side elastic arm center terminal body and a wire side elastic arm center terminal contact portion, the wire side elastic arm center terminal body being penetrated into the wire side insulator;

the wire side shield terminal comprises a wire side shield terminal plug ring;

the wire side elastic arm center terminal contact portion is exposed on a side of the wire side insulator and the wire side shield terminal plug ring;

the wire side shield terminal plug ring plugs the board side shield terminal plug ring from top to bottom, so that the wire side elastic arm center terminal contact portion passes through an interior of the board side shield terminal plug ring to have a direct electrical contact with the substrate central terminal contact portion; and the wire side elastic arm center terminal body has an elastic structure to be abutted on the substrate center terminal contact portion with an elasticity, in order to keep an abutting force applied by the wire side elastic arm center terminal contact portion to the substrate center terminal contact portion, and realize the electrical contact between the wire side elastic arm center terminal contact portion and the substrate center terminal contact portion.

2. The ultra-high frequency super thin coaxial RF connector assembly as claim 1, wherein the wire side elastic arm center terminal body is a cantilever terminal, which tail portion has a wire side elastic arm center terminal joint portion, which joins a cable center conductor of an RF coaxial cable by means of welding, crimped, pressure welding or IDC.

3. The ultra-high frequency super thin coaxial RF connector assembly as claim 1, wherein the wire side insulator has a wire side insulator body, a wire side insulator upper cover and a wire side insulator accommodating space, which is disposed in the wire side insulator body, the wire side insulator upper cover being capable of being flipped upward or moved upward relative to the wire side insulator body to have the wire side insulator accommodating space being exposed, for the wire side elastic arm center terminal body being disposed into the wire side insulator accommodating space, the wire side insulator upper cover being further capable of being flipped downward or moved downward relative to the wire side insulator body to have the wire side insulator accommodating space being shielded, for the wire side elastic arm center terminal body to be confined in the wire side insulator accommodating space.

4. The ultra-high frequency super thin coaxial RF connector assembly as claim 3, wherein the wire side insulator upper cover is further capable of pushing against the wire side elastic arm center terminal body, so that the wire side elastic arm center terminal body forms an elastic cantilever, the elastic cantilever being the elastic structure.

5. The ultra-high frequency super thin coaxial RF connector assembly as claim 3, wherein the wire side insulator upper cover has a wire side insulator upper cover fastening structure for fastening the wire side insulator body to complete positioning of the wire side insulator upper cover.

6. The ultra-high frequency super thin coaxial RF connector assembly as claim 3, wherein the wire side insulator and the wire side elastic arm center terminal form an ultra-high frequency super thin coaxial RF wire side connector semi-finished product, the wire side shield terminal has a wire side shield terminal accommodating space, which accommodates the line end connector semi-finished product, the wire side shield terminal also comprises a wire side shield terminal body and a wire side shield terminal cover, the wire side shield terminal cover joins the wire side shield terminal body, for the ultra-high frequency super thin coaxial RF wire side connector semi-finished product to be confined in the wire side shield terminal accommodating space.

7. The ultra-high frequency super thin coaxial RF connector assembly as claim 6, wherein the wire side shield terminal plug ring is disposed at the wire side shield terminal body or the wire side shield terminal cover.

8. The ultra-high frequency super thin coaxial RF connector assembly as claim 1, wherein, with respect to dimensions for inner diameters of plug rings, the wire side shield terminal plug ring is larger than the board side shield terminal plug ring, and the wire side insulator has a guiding post, which extends outward from the interior of the wire side shield terminal plug ring, and guides the wire side shield terminal plug ring to align with the board side shield terminal plug ring during the wire side shield terminal plugs the board side shield terminal plug ring, in order for the wire side shield terminal plug ring to be plugged into the interior of the board side shield terminal plug ring in the case of blind plug, so that the wire side elastic arm center terminal contact portion is allowed to get close to the substrate center terminal contact portion, ensuring that the wire side elastic arm center terminal contact portion is allowed to be in electrical contact with the substrate center terminal contact portion.

9. The ultra-high frequency super thin coaxial RF connector assembly as claim 1, wherein with respect to dimensions for the inner diameters, the wire side shield terminal plug ring is smaller than the board side shield terminal plug ring, and the board side shield terminal plug ring is in a visible state for the wire side shield terminal plug ring to be aligned with during the wire side shield terminal plug ring plugs the board side shield terminal plug ring, in order for the wire side shield terminal plug ring to be plugged into the interior of the board side shield terminal plug ring in the case of none-blind plug, so that the wire side elastic arm center terminal contact portion is allowed to get close to the substrate center terminal contact portion, ensuring that the wire side elastic arm center terminal contact portion is allowed to be in electrical contact with the substrate center terminal contact portion.

* * * * *